US005540791A

United States Patent [19]

Matsuo et al.

[11] Patent Number: 5,540,791

[45] Date of Patent: Jul. 30, 1996

[54] PREFORMABLE ALUMINUM-ALLOY ROLLED SHEET ADAPTED FOR SUPERPLASTIC FORMING AND METHOD FOR PRODUCING THE SAME

[75] Inventors: Mamoru Matsuo; Tsutomu Tagata, both of Tokyo, Japan

[73] Assignee: Sky Aluminum Co., Ltd., Tokyo, Japan

[21] Appl. No.: 327,904

[22] Filed: Oct. 24, 1994

[51] Int. Cl.$^6$ ..... C22F 1/04

[52] U.S. Cl. ..... 148/549; 148/552; 148/688; 148/692; 148/696; 148/440; 148/564; 420/542; 420/543; 420/545; 420/547; 420/553; 420/902

[58] Field of Search ..... 148/549, 552, 148/688, 692, 696, 440, 564; 420/542, 543, 545, 547, 553, 902

[56] References Cited

U.S. PATENT DOCUMENTS 5,181,969 1/1993 Komatsubara et al. ..... 148/552

FOREIGN PATENT DOCUMENTS 57-152453 9/1982 Japan .
59-28554 2/1984 Japan .
60-238460 11/1985 Japan .
62-7836 1/1987 Japan .
2-285046 11/1990 Japan .

*Primary Examiner*—David A. Simmons
*Assistant Examiner*—Robert R. Koehler
*Attorney, Agent, or Firm*—Armstrong, Westerman, Hattori, McLeland & Naughton

[57] ABSTRACT

An aluminum-alloy rolled sheet is cold preformed and then superplastically formed by: providing a composition which consists of from 2.0 to 8.0% of Mg, from 0.0001 to 0.01% of Be, and at least one element selected from the group consisting of from 0.3 to 2.5% of Mn, from 0.1 to 0.5% of Cr, from 0.1 to 0.5% of Zr, and from 0.1 to 0.5% of V, less than 0.2% of Fe as impurities, as well as aluminum and unavoidable impurities in balance; providing an unrecrystallized structure formed by annealing at a temperature of from 150° to 240° C. for 0.5 to 12 hours or at a temperature of from 250° to 340° C. for 0 to 5 minutes; providing draft of final cold-rolling amounting to 50% or more; and, providing 7% or more of elongation at normal temperature.

14 Claims, 1 Drawing Sheet

PREFORMABLE ALUMINUM-ALLOY ROLLED SHEET ADAPTED FOR SUPERPLASTIC FORMING AND METHOD FOR PRODUCING THE SAME

BACKGROUND OF THE INVENTION

1. Field of the Invention

The present invention relates to an aluminum-alloy rolled sheet adapted for superplastic forming. More particularly, the present invention relates to an aluminum-alloy rolled sheet which can be preformed and then superplastically formed. In addition, the present invention relates to a method for producing such a preformable aluminum-alloy rolled sheet.

2. Description of Related Arts

In recent years, a variety of superplastic materials, which exhibit an exceedingly high elongation without incurring local distortion or necking when stretched at an appropriate strain rate at an elevated temperature, have been developed. Specifically, various studies of aluminum-alloy materials have been directed at those exhibiting superplastic properties at a temperature of 350° C. or more, in terms of elongation of 150% or more.

Aluminum alloy can be readily formed into complicated shapes when conventional superplastic materials are used, such as Al-78% Zn alloy, Al-33% Cu alloy, Al-6% Cu-0.4% Zr alloy (Supral), Al-2.5~6.0% Mg-0.05~0.6% Zr alloy, Al-Zn-Mg-Cu alloys (AA 7474, AA 7075 etc) and the like.

The above mentioned, Al-2.5~6.0% Mg-0.05~0.6% Zr alloy belongs to a JIS 5000 series alloy, i.e., an Al-Mg based alloy, and is a static superplastic material.

The present assignee filed Japanese Patent Application No. 5-47431, in which it is disclosed that not only the above mentioned aluminum alloy but also other Al-Mg alloys can exhibit a static superplastic property provided that: the alloy composition is properly selected; and, the production process of the alloy is properly controlled in such a manner that the grain-diameter of recrystallized grains are very fine when the alloy is subjected to superplastic forming.

In Japanese Unexamined Patent Publication No. 3-89, 893, corresponding to U.S. Patent application Ser. No. 07/711,308 filed by the present assignee, there is disclosed a superplastic forming aluminum alloy, which essentially consists of from 2.0 to 8.0% of Mg, from 0.3 to 1.5% of Mn, from 0.0001 to 0.01% of Be, an optional element selected from Cr, V, and Zr, an optional grain refining agent of Ti or Ti and B, less than 0.2% of Fe and less than 0.1% of Si as impurities, and the balance of Al, wherein the intermetallic compounds have a size of up to 20 μm, and the hydrogen content is up to 0.35 cc/100 grams.

The superplastic materials, whose formability is excellent at elevated temperatures, can be used in various applications. As to the superplastic aluminum-based materials, they can be applied for complicated shaping of various structural parts of automobiles, electric trains, and other vehicles. In the structural application, an importance should be attached not only to the superplastic formability but also the strength.

The conventional aluminum-based superplastic forming materials can attain complicated shaping utilizing superplastic forming but involve a drawback in insufficient strength. More specifically, when the conventional materials are subjected to complicated forming only by superplastic forming, they are highly stretched locally, thereby decreasing the sheet thickness in a certain locality and thus incurring a structurally low-strength portion.

SUMMARY OF THE INVENTION

The present inventors conceived the idea as countermeasure against the above mentioned drawback, of subjecting the material to preliminary forming or preforming, such as cold prior-pressing and then, to superplastic forming. Such a preliminary shaping in a cold state can provide a rough shape, and the subsequent superplastic shaping can provide the shape needed for complicated portions. Local elongation of a workpiece can then be made very intensely at the superplastic working, thereby mitigating the local decrease of the work-piece thickness and hence better maintaining the strength of a shaped article.

In an experiment by the present inventors, the above described, conventional static recrystallizing-type Al-Mg based aluminum alloy was cold preformed, prior to the superplastic forming. It turned out that, as a result of cold preforming, the superplastic property was drastically degraded or the preforming at a cold state was extremely difficult prior to the superplastic forming.

Generally, the method for superplastically forming a static superplastic type Al-Mg based aluminum-alloy rolled sheet is roughly classified as follows: a rolled sheet is subjected to recrystallizing treatment and subsequently to superplastic forming under a predetermined temperature-range, or; an as-rolled sheet is loaded into a superplastic furnace and is heated to the superplastic forming temperature. The recrystallizing has been completed during the temperature elevating up to the superplastic forming temperature in the latter method. When the cold preforming prior to superplastic forming is applied to the former method, since a sheet which has a recrystallized structure and soft temper, is cold preformed, the cold preforming would by itself be easy. However, since strain has been introduced at a cold state into a recrystallized sheet, when the preformed sheet is subjected to superplastic forming, grain-coarsening occurs locally at the superplastic forming temperature, with the result that the superplastic property is drastically degraded. On the other hand, when the cold preforming prior to superplastic forming is applied in the latter method, since a sheet which has not yet been recrystallized and hence has a low elongation, is cold preformed, the cold preforming is virtually impossible.

In the light of the above described prior art, it is therefore an object of the present invention to provide a novel aluminum-alloy rolled sheet which exhibits both the superplastic formability attained heretofore and cold preformability which allows such a rough shaping as to avoid any local over-stretching and hence local decrease of sheet thickness during the superplastic forming.

It is another object of the present invention to provide a method for producing an aluminum-alloy rolled sheet which can be commercially preformed without impairing the superplastic property.

In order to overcome the drawbacks of the conventional Al-Mg based aluminum-alloy rolled sheet adapted for superplastic forming, the present inventors conducted experiments and research and discovered the following. That is, an Al-Mg based aluminum-alloy rolled sheet, which has not yet been recrystallized, exhibits 7% or more of elongation at normal temperature, provided that the alloy composition and process conditions are properly determined and adjusted. The present invention was completed based on this discovery.

In accordance with one of the objects of the present invention, there is provided an aluminum-alloy rolled sheet, finally cold-rolled at a draft of 50% or more and adapted for cold preforming and subsequent superplastic forming, which consists of from 2.0 to 8.0% of Mg, from 0.0001 to 0.01% of Be, and at least one element selected from the group consisting of from 0.3 to 2.5% of Mn, from 0.1 to 0.5% of Cr, from 0.1 to 0.5% of Zr, and from 0.1 to 0.5% of V, less than 0.2% of Fe as impurities, as well as aluminum and unavoidable impurities in balance, whose crystal structure is an unrecrystallized one formed by annealing at a temperature of from 150° to 240° C. for 0.5 to 12 hours or at a temperature of from 250° to 340° C. for 0 to 5 minutes, and which has 7% or more of elongation at normal temperature.

In accordance with another object of the present invention, there is provided a method for producing an aluminum-alloy rolled sheet adapted for cold preforming and subsequent superplastic forming, whose crystal structure is an unrecrystallized one and which has 7% or more of elongation at normal temperature, which process comprises:

casting an alloy which consists of from 2.0 to 8.0% of Mg, from 0.0001 to 0.01% of Be, and at least one element selected from the group consisting of from 0.3 to 2.5% of Mn, from 0.1 to 0.5% of Cr, from 0.1 to 0.5% of Zr, and from 0.1 to 0.5% of V, less than 0.2% of Fe as impurities, as well as aluminum and unavoidable impurities in balance;

rolling the cast alloy to a final sheet thickness, including a final cold-rolling;

carrying out the final cold-rolling at a draft of 50% or more; and, subjecting the aluminum-alloy rolled sheet having the final, desired thickness to a final annealing, in which heating up to a temperature range of from 150° to 240° C. is carried out at a temperature-elevating rate of 10° C./minute or less, the temperature is held within said temperature range for 0.5 hour to 12 hours, followed by cooling at a rate of 10° C./minute or less.

In accordance with a further object of the present invention, there is provided a method for producing an aluminum-alloy rolled sheet adapted for cold preforming and subsequent superplastic forming, whose crystal structure is an unrecrystallized structure and which has 10% or more of elongation at normal temperature, which process comprises:

casting an alloy which consists of from 2.0 to 8.0% of Mg, from 0.0001 to 0.01% of Be, and at least one element selected from the group consisting of from 0.3 to 2.5% of Mn, from 0.1 to 0.5% of Cr, from 0.1 to 0.5% of Zr, and from 0.1 to 0.5% of V, less than 0.2% of Fe as impurities, as well as aluminum and unavoidable impurities in balance;

rolling the cast alloy to a final sheet thickness, including a final cold-rolling;

carrying out the final cold-rolling at a draft of 50% or more; and, subjecting the aluminum-alloy rolled sheet having the final, thickness to a final annealing, in which heating up to a temperature range of from 250° to 340° C. is carried out at a temperature-elevating rate of 1° C./second or more, temperature is not held or held within said temperature range for 5 minutes or less, followed by cooling at a rate of 1° C./second or less.

DESCRIPTION OF THE PREFERRED EMBODIMENTS

The reason for limiting the contents of the alloying components is first described.

Mg: 2.0 to 8.0%

Mg is effective for attaining the objects of the present invention in the light of the following two aspects.

(a) When an aluminum-alloy rolled sheet is cold preformed and is then heated to the superplastic forming temperature, the added Mg refines the recrystallized grains which generate during the temperature-elevating process where the recrystallizing occurs. As a result, the superplastic formability is enhanced.

(b) Strength and superplastic formability are enhanced without impairing the corrosion resistance and weldability of the material.

Less than 2.0% of Mg is insufficient to impart the superplastic formability, whereas alloys containing more than 8.0% of Mg are difficult to produce due to poor workability during hot rolling and cold rolling. Preformability is also impaired. The Mg content is therefore in the range of from 2.0 to 8.0%, preferably from 3 to 6%.

Be: 0.0001–0.01%

Beryllium is generally added to prevent oxidation of Mg upon melting of the aluminum alloy. In the alloy composition of the present invention, Be forms a dense oxide film on the surface of a melt and is thus effective for preventing the hydrogen entry into the melt, thus preventing cavitation of a rolled sheet being superplastically formed. The cavitation causes decreases in the elongation of a rolled sheet during the superplastic forming and the mechanical properties and corrosion resistance of a superplastically formed article.

Beryllium suppresses oxidation of Mg on the surface of a rolled sheet and stablizes its surface. More specifically, since the superplastic forming is carried out at an elevated temperature of from 350° to 560° C. the surface of such an aluminum-alloy rolled sheet containing a high amount of Mg, as does the present invention, can undergo severe oxidation during the superplastic forming, so that the surface is liable to blacken. The addition of Be restrains the surface oxidation during the superplastic forming, thus stabilizing the surface of a finished article.

When the Be content is less than 0.0001% (1 ppm), the above effects are not realized. On the other hand, when the Be content is more than 0.01% (100 ppm), not only the above effects saturate but also toxity and economical problems arise. The Be content is therefore from 0.0001 to 0.01%.

Mn, Cr, V and Zr:

Each of these elements is effective for refining the recrystallized grains which are formed during the temperature-elevating process up to the superplastic-formation temperature. Each element is also effective for preventing an abnormal coarsening of the crystal grains during the superplastic forming. One or more of these elements is therefore added to attain these effects. Less than 0.3% of Mn and less than 0.1% of Cr, Zr and V are ineffective for satisfactorily attaining these effects. More than 2.5% of Mn and more than 0.5% of each of Cr, Zr and V cause formation of coarse intermetallic compounds so that the superplastic forming becomes difficult. The Mn content is therefore from 0.3 to 2.5%, and each of Cr, Zr and V is from 0.1 to 0.5%.

Furthermore, Fe, Si, Cu, Zn and the like are contained as impurities in the ordinary aluminum alloys. Among these impurities, Fe exerts serious influence upon the inventive aluminum alloy and should thus be controlled as follows.

Fe: less than 0.2%

Iron, if present in substantial content, tends to allow intermetallic compounds such as Al-Fe, Al-Fe-Mn (—Si), Al-Fe-Si and the like, to crystallize out, which will cause cavitation during the superplastic forming and a lowering of superplastic elongation. The presence of cavities, of course, results in loss of mechanical properties, fatigue resistance and corrosion resistance. Therefore, a lower iron content is desirable. Iron also exerts some influence upon the Mn precipitation, with a higher Fe content resulting in promoting the crystallizing of coarse intermetallic compounds. In order to avoid the detrimental effects of Fe, the Fe content should be limited to less than 0.2%.

The components of the alloy other than the above mentioned essential and optional elements may be basically aluminum and impurities including the iron described above. However, if silicon as an impurity is present in substantial content, coarse intermetallic compounds such as α Al-Mn (Fe)-Si phase and $Mg_2Si$ phase are liable to crystallize out, thereby increasing the cavities and exerting a detrimental infulence upon the superplastic property. Si is therefore preferably limited to less than 0.5%. Furthermore, a substantial content of Cu makes the hot-rolling difficult. The Cu content is therefore preferably limited to less than 0.3%. Zn as an impurity does not impair the properties of the inventive aluminum-alloy sheet at all, provided that its content is approximately 0.5% or less. Zn in an amount of approximately 0.5% or less is therefore permissible.

Titanium alone or titanium along with boron or carbon is generally added to melt prior to or during casting in the production of an aluminum-alloy rolled sheet for superplastic forming according to the present invention, so as to refine the cast structure. When the Ti content exceeds 0.15%, coarse primary $TiAl_3$ crystals are liable to crystallize out and exert detrimental influence upon the superplastic formability. The Ti content is therefore preferably 0.15% or less. Each of B and C further promotes refinement and uniformity of the crystal grains, when added in the copresence of Ti. However, more than 0.05% of B causes formation of $TiB_2$ particles, and more than 0.05% of C causes formation of graphite, with the result that the superplastic formability is detrimentally influenced in each case. The amount of B and C added together with Ti is preferably 0.05% each or less.

In the rolled aluminum-alloys of the present invention adapted to superplastic forming, their chemical composition is limited as described above. The rolled aluminum-alloys of the present invention must fulfill all of the requirements for the chemical composition, the draft of the last cold-rolling, annealing conditions and the metal-structure requirement, i.e., unrecrystallized structure, so as to attain the cold-preforming prior to the superplastic forming. If an aluminum-alloy rolled sheet having recrystallized structure is subjected to preforming, cold strains at various levels are introduced into the sheet, which is subsequently heated to a superplastic forming temperature in the range of from 350° C. to 560° C. Due to the strains introduced, grain coarsening occurs to such a level that the superplastic formability and the properties of product are impaired. Contrary to this, if an aluminum-alloy rolled sheet having unrecrystallized structure is subjected to preforming, such grain-coarsening as to impair the superplastic formability does not occur when the aluminum-alloy rolled sheet is subsequently heated to a superplastic forming temperature. During the temperature-elevating stage up to the superplastic forming temperature, fine recrystallized grains are formed and contribute to the superplastic forming. As a result, the superplastic formability is improved according to the present invention.

In addition, the aluminum-alloy rolled sheet adapted for superplastic forming according to the present invention must have 7% or more of elongation, preferably 10% or more, at normal temperature, so as to enable the cold preforming. Generally speaking, since the Al-Mg based alloy, in which an inventive subject matter is included, is extremely brittle at a cold-worked state and has very low elongation, such an alloy cannot withstand the cold preforming and occasionally results in rupture. It cannot be said that the cold preforming is possible unless the elongation is at least 7%, although higher elongation is more preferable.

A method for producing the aluminum-alloy rolled sheet adapted for superplastic forming is now described.

The alloy melt, whose composition is adjusted as described above, is prepared and cast usually by direct chill casting. A continuous sheet casting method, for example, the roll cast method, can however be used for casting. As is described above, Ti alone or with B or C, as the cast-structure refining agent, may be added to the alloy melt prior or subsequent to the casting.

A cast ingot obtained by the DC casting is scalped prior to the hot-rolling, if necessary, and is then subjected to heating or homogenizing at a temperature of from 400° to 560° C. for the holding time of from 0.5 to 24 hours. This ingot heating may be carried out either in one stage for simultaneously homogenizing and preheating prior to the hot-rolling, or in two separate stages for homogenizing and the pre-hot-rolling heating, respectively. Subsequent to the ingot heating, hot-rolling is carried out in a conventional manner. A hot-rolled sheet is then cold-rolled so as to reduce its thickness to the final one required for a workpiece of the superplastic forming. Between the hot rolling and cold rolling or in the course of reducing the thickness by cold-rolling, an intermediate annealing may be carried out once or more under the condition as described above.

The conditions for intermediate annealing are not specified at all. However, in the case of batch type intermediate annealing, a condition of 250° to 450° C. for 0.5 to 12 hours is preferred. In the case of continuous type annealing, a condition of 400° to 550° C. for 0 to 30 second is preferred.

A cast sheet in the form of a coil obtained by continuous casting is subjected to homogenizing at a temperature of 400° to 560° C. for 0.5 to 24 hours. Then, the final sheet thickness is obtained only by cold rolling without prior use of hot rolling. In the course of cold rolling, an intermediate annealing may be carried out once or more under the conditions described above.

In the production method according to the present invention, the draft of cold-rolling prior to obtaining the final sheet-thickness must be 50% or more. The cold rolling prior to obtain ing the final sheet-thickness is the whole cold-rolling which reduces the sheet thickness to its final size. In this case, the intermediate annealing is not carried out. The cold-rolling prior to obtaining the final sheet thickness may be the last of the cold-rollings. In this case, an intermediate annealing is carried out once or more. The draft of the last cold-rolling is 50% or more according to the present invention. When the draft of the cold-rolling prior to obtaining the final sheet-thickness is less than 50%, the recrystallized grains coarsen in the temperature-elevating stage of the heating to the superplastic forming temperature, resulting in insufficient superplastic property. Contrary to this, when the draft of the cold-rolling prior to obtaining the final sheet-thickness is 50% or more, recrystallized grains do not coarsen in the temperature-elevating stage for heating to the superplastic forming temperature, and remain so fine that improved superplastic formability is realized during the superplastic forming. The micro-structure of the aluminum-alloy rolled sheet according to the present invention is described with reference to the drawings.

BRIEF DESCRIPTION OF DRAWINGS

FIG. 1(*b*) is an optical microscope photograph of the unrecrystallized structure at magnification of 250.

Figure 1A:
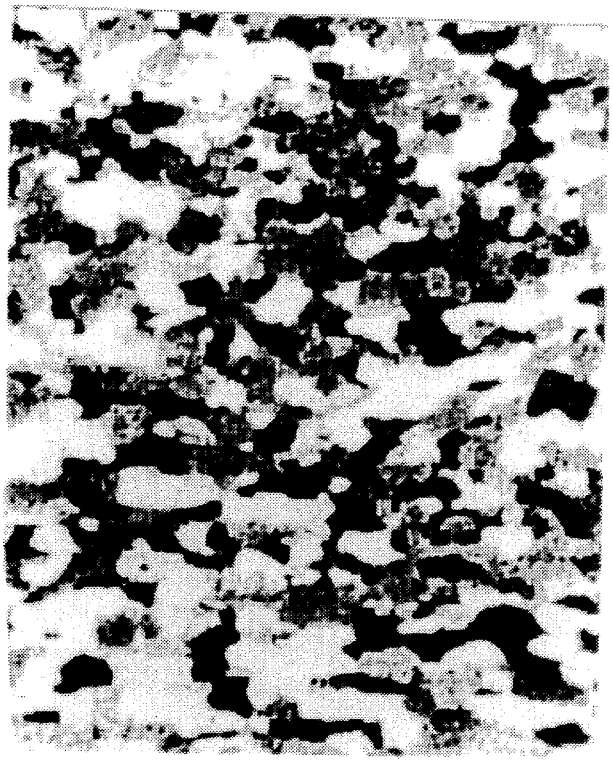
FIG. 1(*a*) is an optical microscope photograph of the recrystallized structure at magnification of 250.
Figure 1B:
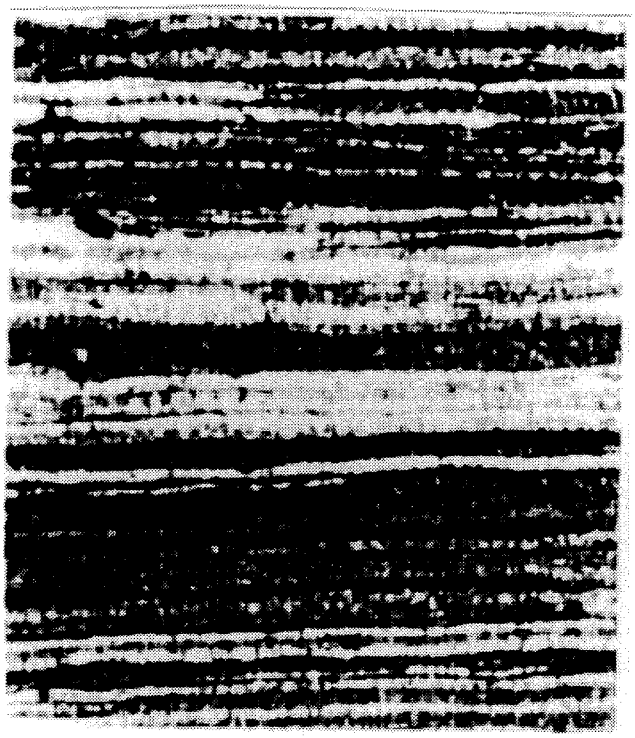

An aluminum-alloy rolled sheet having the final sheet-thickness is subjected to the final annealing, which is necessary to impart ductility to a sheet and hence to adjust the normal-temperature elongation to a level or 7% or more. The final annealing must be controlled so as to maintain the unrecrystallized structure. The "unrecrystallized structure" herein indicates a micro-structure finally cold rolled at a draft of at least 50%, and then annealed but not yet recrystallized and fiber-like as shown in FIG. 1(*b*), which is distinct from essentially equi-axed recrystallized structure shown in FIG. 1(*a*). The final annealing may be carried out either in a batch-type annealing furnace or a continuous annealing furnace, in which an uncoiled sheet is annealed during continuous conveyance therethrough.

In the case of batch-type final annealing, the temperature is elevated at a rate of 10° C./minute or less, the heating is carried out at a temperature of from 150° C. to 240° C., the temperature is held for 0.5 to 12 hours, and, subsequently cooling is carried out at a rate of 10° C./minute or less. When the heating temperature is less than 150° C. and the holding time is less than 0.5 hours, the ductility is not satisfactorily enhanced so that the cold preforming is difficult to carry out. On the other hand, a heating temperature higher than 240° C. causes recrystallization. In this case, although cold preforming is possible, grain-coarsening occurs during the superplastic forming, thereby impairing the superplastic formability. In addition, when the holding time exceeds 12 hours, the annealing effects saturate and merely the economic structure is impaired.

In the case of continuous final annealing, the temperature is elevated at a rate of 1° C./second or more, the heating is carried out at a temperature of from 250° C. to 340° C., the temperature is not held at all or held for 5 minutes or less, and, subsequent cooling is carried out at a rate of 1° C./second or more. When the heating temperature is less than 250° C., the ductility is not satisfactorily enhanced so that the cold preforming is difficult to carry out. On the other hand, when the heating temperature is higher than 340° C. or the holding time is longer than 5 minutes, grain-coarsening occurs during the superplastic forming, thereby impairing the superplastic formability.

The actual condition of the final annealing is adjusted within the above mentioned ranges to an optimum one taking the actual composition into consideration so that as high an elongation as possible, and 7% or more, is obtained while maintaining the unrecrystallized structure.

An aluminum-alloy rolled sheet according to the present invention is one produced by the process described hereinabove. Although the aluminum-alloy rolled sheet according to the present invention has an unrecrystallized structure, since it has 7% or more of elongation and relatively good ductility, it can be cold preformed prior to the superplastic forming. The superplastic forming subsequent to the cold preforming is usually carried out in a temperature range of from 350° to 560° C. In the aluminum-alloy rolled sheet according to the present invention, recrystallization structure, which is formed at the temperature-elevating stage up to the superplastic forming temperature, is fine. Since grain coarsening does not occur, the plastic formability is improved.

The present invention is hereinafter described by way of Examples.

The alloys Nos. 1–8, whose composition is shown in Table 1, were cast by a DC casting method in a conventional manner, into slabs with a cross sectional dimension of 450 mm×1300 mm. Alloys Nos. 1–7 have a composition which falls within a range specified by the present invention, while Alloy No. 8 has a composition outside the range specified by the present invention and is hence comparative. The slabs were scalped by 12 mm on each surface, then soaked at 530° C. for 6 hours, and again heated at 450° C. The slabs were then hot-rolled to produce hot-rolled sheet having 6 mm of sheet thickness. Several of the 6 mm hot-rolled sheets were single cold-rolled, and the other sheets were cold-rolled in multistages with an intermediate annealing. The finished thickness after cold rolling was 2 mm. Most of the finished sheets were subjected to the final annealing either by batch annealing or continuous annealing under various conditions. The conditions of cold-rolling and final annealing are indicated in the production numbers Nos. 1 through 7 of Table 1.

TABLE 1

| Alloy No. | Composition (wt % except for B, Be) | | | | | | | | | | |
|---|---|---|---|---|---|---|---|---|---|---|---|
| | Mg | Mn | Cr | Zr | V | Fe | Si | Ti | B (ppm) | Be (ppm) | Al Remarks |
| 1 | 4.2 | 0.62 | — | — | — | 0.07 | 0.07 | — | — | 11 | bal Inventive |
| 2 | 4.8 | 0.65 | — | 0.12 | — | 0.05 | 0.05 | 0.01 | 4 | 10 | bal Inventive |
| 3 | 4.3 | 0.59 | — | — | 0.15 | 0.06 | 0.03 | 0.01 | 7 | 8 | bal Inventive |
| 4 | 4.7 | — | 0.18 | — | — | 0.05 | 0.03 | 0.01 | 6 | 5 | bal Inventive |
| 5 | 4.5 | 0.72 | 0.11 | — | — | 0.06 | 0.04 | 0.01 | — | 6 | bal Inventive |
| 6 | 3.9 | 1.51 | — | — | — | 0.04 | 0.06 | 0.02 | 8 | 9 | bal Inventive |
| 7 | 5.2 | 1.31 | — | — | — | 0.07 | 0.06 | 0.01 | 4 | 21 | bal Inventive |
| 8 | 4.3 | — | — | — | — | 0.12 | 0.21 | 0.01 | 5 | — | bal Comparative |

The microstructure of every one of the final annealed sheets was investigated at normal temperature so as to determine the presence or absence of recrystallization. Tensile specimens No. 5 stipulated by JIS were sampled parallel to the rolling direction and its tensile strength and elongation were measured at normal temperature.

Furthermore, every one of the final annealed sheets were cold-rolled at 10%, which simulates the cold-preforming, and then heated to 520° C. At this temperature, the superplastic forming test was carried out to measure the superplastic elongation. The superplastic forming samples were 4 mm in width and 15 mm in length parallel side portion. The strain rate at the tensile test was $1\times10^{-3}$/ second.

The results of the above tests are shown in Table 3. The formability at normal temperature was evaluated as excellent with more than 20% of elongation (indicated by ⊙ mark), as good with 7% or more of elongation (indicated by ○ mark), and as poor with less than 7% of elongation (indicated by x mark). The superplastic property was evaluated as excellent with 150% or more of superplastic elongation (indicated by ○ mark), and as poor withless than 150% of elongation (indicated by x mark). The total evaluation was good (indicated by ○ mark), when The total elongation was good (indicated by ○ mark), when the formability elongation at normal temperature was ⊙ or ○, and when the elongation at normal temperature of superplastic property was ○. For the other cases, the total evaluation was indicated as x.

preformed before the superplastic forming, and, further exhibits good superplastic formability.

On the other hand, the final annealing did not take place in Production Nos. 2 and 15 for the comparison purpose, and the temperature of the final annealing was very low in Production No. 13. In the comparative examples corresponding to them, although the composition falls within the inventive range, the elongation is less than 7% at normal temperature and hence the formability at normal temperature is poor. Clearly, the cold preforming is difficult.

TABLE 2

| Prod. | Alloy | Cold rolling | | Final Annealing | | |
|---|---|---|---|---|---|---|
| No. | No. | I.A. | Draft (%) | Type | Condition | Remarks |
| 1 | 1 | none | 67 | Batch | 220° C. × 5H | Inventive |
| 2 | 1 | none | 67 | | none | Comparative |
| 3 | 1 | none | 67 | Continuous | 480° C. × 0 sec | Comparative |
| 4 | 1 | at 3 mm 350° C. × 2H | 33 | Batch | 220° C. × 5H | Comparative |
| 5 | 2 | none | 67 | Batch | 220° C. × 5H | Inventive |
| 6 | 2 | none | 67 | Continuous | 320° C. × 0 sec | Inventive |
| 7 | 3 | none | 67 | Batch | 220° C. × 5H | Inventive |
| 8 | 3 | none | 67 | Continuous | 320° C. × 0 sec | Inventive |
| 9 | 4 | none | 67 | Batch | 220° C. × 5H | Inventive |
| 10 | 4 | none | 67 | Continuous | 300° C. × 0 sec | Inventive |
| 11 | 5 | none | 67 | Continuous | 340° C. × 0 sec | Inventive |
| 12 | 6 | none | 67 | Continuous | 340° C. × 0 sec | Inventive |
| 13 | 6 | none | 67 | Batch | 100° C. × 2H | Comparative |
| 14 | 7 | none | 67 | Batch | 220° C. × 5H | Inventive |
| 15 | 7 | none | 67 | | none | Comparative |
| 16 | 8 | none | 67 | Batch | 220° C. × 5H | Comparative |
| 17 | 8 | none | 67 | | none | Comparative |

I.A.: intermediate annealing.
Draft: draft of final rolling.

TABLE 3

| Production No. | Alloy No. | Crystal structure of final sheet | Elongation at normal temperature (%) | Formability at normal temperature | Super plastic elongation (%) | Evaluation of superplastic property | Comprehensive evaluation | Remarks |
|---|---|---|---|---|---|---|---|---|
| 1 | 1 | Unrecrystallized | 20 | ○ | 342 | ○ | ○ | Inventive |
| 2 | 1 | Unrecrystallized | 3 | X | 348 | ○ | X | Comparative |
| 3 | 1 | Unrecrystallized | 26 | ⊙ | 78 | X (*G.G.) | | Comparative |
| 4 | 1 | Unrecrystallized | 19 | ○ | 138 | X | X | Comparative |
| 5 | 2 | Unrecrystallized | 12 | ○ | 318 | X | ○ | Inventive |
| 6 | 2 | Unrecrystallized | 16 | ○ | 320 | ○ | ○ | Inventive |
| 7 | 3 | Unrecrystallized | 14 | ○ | 308 | ○ | ○ | Inventive |
| 8 | 3 | Unrecrystallized | 15 | ○ | 312 | ○ | ○ | Inventive |
| 9 | 4 | Unrecrystallized | 17 | ○ | 300 | ○ | ○ | Inventive |
| 10 | 4 | Unrecrystallized | 15 | ○ | 290 | ○ | ○ | Inventive |
| 11 | 5 | Unrecrystallized | 15 | ○ | 295 | ○ | ○ | Inventive |
| 12 | 6 | Unrecrystallized | 16 | ○ | 368 | ○ | ○ | Inventive |
| 13 | 6 | Unrecrystallized | 6 | X | 312 | ○ | X | Comparative |
| 14 | 7 | Unrecrystallized | 19 | ○ | 311 | ○ | ○ | Inventive |
| 15 | 7 | Unrecrystallized | 2 | X | 296 | ○ | X | Comparative |
| 16 | 8 | Unrecrystallized | 16 | ○ | 121 | X | X | Comparative |
| 17 | 8 | Unrecrystallized | 5 | X | 131 | X | X | Comparative |

*G.G. indicates coarse grain growth.

As is shown in Table 3, every one of the inventive aluminum-alloy rolled sheets, which have a composition falling within the inventive range and unrecrystallized structure, and 7% or more of elongation, exhibits improved formability at normal temperature and can be easily cold In a comparative example (Production No. 3), the chemical composition falls within the inventive range but the temperature of the final annealing is higher than that of the inventive range. In this case, recrystallization occurs during the final annealing and grain coarsening occurs during the superplastic forming. The elongation at the superplastic forming is low and hence the superplastic formability is poor.

In a comparative example (Production No. 4), the cold-rolling draft before the final sheet thickness is small. Also in this case, the elongation at the superplastic forming is not satisfactory.

When a comparative alloy falling outside the inventive composition range, i.e., Alloy No. 8, containing none of Mn, Zr, Cr and V or Be, is subjected to the process of Production No. 16 fulfilling the inventive range, satisfactorily high superplastic elongation is not obtained.

When the final annealing is not carried out, the superplastic elongation is high. But, the elongation at normal temperature is so low that the preforming becomes difficult to carry out.

As is clear from the foregoing examples, the cold preforming is easy to carry out before the superplastic forming and the superplastic formability is not impaired by the preforming at all, according to the present invention. The degree of rough shaping in the cold preforming can be as high as the level permissible by the elongation of the inventive aluminum-alloy sheet. The superplastic forming of the roughly shaped sheet is regulated to obtain the shape of complicated portions of the final product, therby preventing local reduction in thickness of the final product and hence problems in strength of the final product when used as a construction part.

What is claimed is:

1. An aluminum-alloy rolled sheet comprising an alloy consisting essentially of from 2.0 to 8.0% of Mg, from 0.0001 to 0.01% of Be and at least one element selected from the group consisting of from 0.3 to 2.5% of Mn, from 0.1 to 0.5% of V, less than 0.2% of Fe as impurities, as well as aluminum and unavoidable impurities in balance, whose crystal structure is an unrecrystallized one formed by annealing of a finally cold-rolled sheet at a temperature of from 150° to 240° C. for 0.5 to 12 hours, and which has 7% or more of elongation at normal temperature, and wherein said sheet is finally cold-rolled at a draft of 50% or more and suitable for cold performing and subsequent super-plastic forming.

2. An aluminum-alloy rolled sheet according to claim 1, wherein the elongation at normal temperature is 10% or more.

3. An aluminum-alloy rolled sheet according to claim 1, further containing 0.15% or less of Ti and 0.05% or less of at least one element selected from the group consiting of B and C.

4. An aluminum-alloy rolled sheet according to claim 1, 2, or 3, wherein the Mg content is from 3 to 6%.

5. An aluminum alloy rolled sheet comprising an alloy consisting essentially of from 2.0 to 8.0% of Mg, from 0.0001 to 0.01% of Be and at least one element selected from the group consisting of from 0.3 to 2.5% of Mn, from 0.1 to 0.5% of V, less than 0.2% of Fe as impurities, as well as aluminum and unavoidable impurities in balance, whose crystal structure is an unrecrystallized one formed by annealing of a finally cold-rolled sheet at a temperature of from 250° to 340° C. for 0 to 5 minutes, and which has 7% or more of elongation at normal temperature, and wherein said sheet is finally cold-rolled at a draft of 50% or more and suitable for cold performing and subsequent super-plastic forming.

6. An aluminum-alloy rolled sheet according to claim 5, wherein the elongation at normal temperature is 10% or more.

7. An aluminum-alloy rolled sheet according to claim 5, further containing 0.15% or less of Ti and 0.05% or less of at least one element selected from the group consiting of B and C.

8. An aluminum-alloy rolled sheet according to claim 5, 6 or 7, wherein the Mg content is from 3 to 6%.

9. A method for producing an aluminum-alloy rolled sheet suitable for cold preforming and subsequent superplastic forming, whose crystal structure is unrecrystallized structure and which has 7% or more of elongation at normal temperature, comprising the steps of:

casting an alloy which consists of from 2.0 to 8.0% of Mg, from 0.0001 to 0.01% of Be, and at least one element selected from the group consisting of from 0.3 to 2.5% of Mn, from 0.1 to 0.5% of Cr, from 0.1 to 0.5% of Zr, and from 0.1 to 0.5% of V, less than 0.2% of Fe as impurities, as well as aluminum and unavoidable impurities in balance;

rolling the cast alloy to a final sheet thickness, inclusing a final cold-rolling;

carrying out the final cold-rolling at a draft of 50% or more; and, subjecting the aluminum-alloy rolled sheet having the final thickness to a final annealing, in which heating up to a temperature range of from 150° to 240° C. is carried out at a temperature-elevating rate of 10° C./minute or less, temperature is held within said temperature range for 0.5 hour to 12 hours, then, and, followed by cooling at a rate of 10° C./minute or less.

10. A method for producing an aluminum-alloy rolled sheet according to claim 9, wherein said aluminum-alloy further contains 0.15% or less of Ti and 0.05% or less of at least one element selected from the group consiting of B and C.

11. A method for producing an aluminum-alloy rolled sheet according to claim 9, wherein the Mg content is from B to 6%.

12. A method for producing an aluminum-alloy rolled sheet adapted for cold preforming and subsequent superplastic forming, whose crystal structure is an unrecrystallized one and which has 7% or more of elongation at normal temperature, which process comprising the steps of:

casting an alloy which consists of from 2.0 to 8.0% of Mg, from 0.0001 to 0.01% of Be, and at least one element selected from the group consisting of from 0.3 to 2.5% of Mn, from 0.1 to 0.5% of Cr, from 0.1 to 0.5% of Zr, and from 0.1 to 0.5% of V, less than 0.2% of Fe as impurities, as well as aluminum and unavoidable impurities in balance;

rolling the cast alloy to a final sheet thickness, including a final cold-rolling;

carrying out the final cold-rolling at a draft of 50% or more; and, subjecting the aluminum-alloy rolled sheet having the final thickness to a final annealing, in which heating up to a temperature range of from 250° to 340° C. is carried out at a temperature-elevating rate of 1° C./second or more, temperature is not held or held within said temperature range for 5 minutes or less, and followed by cooling at a rate of 1° C./second or less.

13. A method for producing an aluminum-alloy rolled sheet according to claim 12, wherein said aluminum-alloy further contains 0.15% or less of Ti and 0.05% or less of at least one element selected from the group consiting of B and C.

14. A method for producing an aluminum-alloy rolled sheet according to claim 12, wherein the Mg content is from 3 to 6%.

* * * * *